US010743640B2

(12) United States Patent
Lababidi

(10) Patent No.: US 10,743,640 B2
(45) Date of Patent: Aug. 18, 2020

(54) NASOLABIAL MOUTHPIECE

(71) Applicant: Mohamad Hani Lababidi, Columbia, SC (US)

(72) Inventor: Mohamad Hani Lababidi, Columbia, SC (US)

( * ) Notice: Subject to any disclaimer, the term of this patent is extended or adjusted under 35 U.S.C. 154(b) by 142 days.

(21) Appl. No.: 16/148,406

(22) Filed: Oct. 1, 2018

(65) Prior Publication Data

US 2020/0100580 A1 Apr. 2, 2020

(51) Int. Cl.
*A45D 44/22* (2006.01)

(52) U.S. Cl.
CPC ..... *A45D 44/22* (2013.01)

(58) Field of Classification Search
CPC ..... A45D 44/22; A45D 27/38; A63B 23/03; A63B 23/032
See application file for complete search history.

(56) References Cited

U.S. PATENT DOCUMENTS 8,419,595 B1 * 4/2013 Hanswirth ..... A63B 21/00189 482/10
9,936,792 B2 * 4/2018 Bruce ..... A45D 44/22
2008/0193897 A1 * 8/2008 Kubo ..... A61C 7/08 433/140

FOREIGN PATENT DOCUMENTS

JP 6265298 B1 * 1/2018 ..... A63B 23/03

* cited by examiner

*Primary Examiner* — Ashley L Fishback
(74) *Attorney, Agent, or Firm* — Melissa B. Neely

(57) ABSTRACT

The invention disclosed in this application is a non-invasive means for treatment of the nasolabial fold to decrease the prominence of the fold and provide a more youthful appearance. The invention is a pair of inserts that fills the canine fossa and thus decreases the indentation of the nasolabial fold. The inserts are held in place by the anatomical structure of the area. An optional connective piece between the two inserts may also be used to provide additional stability.

1 Claim, 3 Drawing Sheets

NASOLABIAL MOUTHPIECE

CROSS REFERENCE TO RELATED APPLICATIONS

Not Applicable

STATEMENT REGARDING FEDERALLY SPONSORED RESEARCH OR DEVELOPMENT

This invention was not made by an agency of the United States Government nor under a contract with an agency of the United States Government.

THE NAME OF THE PARTIES TO JOINT RESEARCH AGREEMENT

Not Applicable.

INCORPORATION BY REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable

BACKGROUND OF THE INVENTION

Field of the Invention

Nasolabial creases are the skin folds that run from each side of the nose to the corner of the mouth. They are also referred to as nasolabial folds or more commonly smile or laugh lines. Nasolabial folds are naturally occurring and become more pronounced as we age. They can also be exacerbated by such factors as sun damage to the skin, smoking, facial expressions and weight loss.

While some view the increased prominence of nasolabial creases as a normal part of aging, others wish to decrease the prominence of the nasolabial creases to have a more youthful appearance. There are number of methods for treatment of nasolabial creases including plastic surgery, injections with hyaluronic acid (Restylane® and Juvederm®) or injections with botulinum toxin (Botox®).

The present invention, the Nasolabial Mouthpiece utilizes soft rubber like shaped inserts to fill the nasolabial crease to create a natural looking appearance. The mouthpiece can be worn while eating and drinking and will not affect the wearer's speech or facial expressions.

Description of Related Art

The Cheek Uplift (U.S. Pat. No. 2,842,119 issued Jul. 8, 1958 to Mildred Walton) describes a pad-like device that is inserted into the mouth between the upper lip and the upper gum for the purpose of improving the facial appearance of the user by exerting a light outward pressure on the lip and/or cheek. The device consists of a soft body inside a cover or sheath made of a waterproof material to prevent moisture from the mouth entering into the body portion of the pad.

BRIEF SUMMARY OF THE INVENTION

Nasolabial creases or nasolabial folds are the skin folds that run from each side of the nose to the corner of the mouth. Nasolabial creases or folds are sometimes referred to as smile or laugh lines. Current medical treatment options for reducing the prominence of nasolabial folds include plastic surgery, injections of hyaluronic acid (Restylane® or Juvederm®) or injections of botulinum toxin (Botox®). The present invention relates to a non-invasive method to reduce the prominence of the nasolabial fold without resorting to surgery or chemical injections.

The Nasolabial Mouthpiece consists of one or more inserts made from soft rubber like material and is longitudinal shaped to fill the canine fossa of the maxillary bone. By filling this depression in the bone, the device "fills" from nasolabial fold and decreases its prominence in the wearer's appearance.

The invention consists of a right and left insert for each side of the face which can be placed separately or connected to each with a connective piece that rests between the upper gum and upper lip.

DETAILED DESCRIPTION OF THE INVENTION

Nasolabial creases (nasolabial folds) are the skin folds that run from each side of the nose to the corner of the mouth. They are also more referred to as smile or laugh lines. Nasolabial folds are naturally occurring and become more pronounced as we age. They can also be exacerbated by such factors as sun damage to the skin, smoking, facial expressions and weight loss.

While some view the increased prominence of nasolabial creases as a normal part of aging, others wish to decrease the prominence of the nasolabial creases to have a more youthful appearance. Current medical treatments of nasolabial creases including plastic surgery, injections with hyaluronic acid (Restylane® and Juvederm®) or injections with botulinum toxin (Botox®).

The present invention, the Nasolabial Mouthpiece relates to a non-invasive method to reduce the prominence of the nasolabial fold without resorting to surgery or chemical injections. The Nasolabial Mouthpiece consists of two inserts (10) with a connective piece (20). The inserts (10) can be used without the connective piece (20).

The inserts (10) are shaped to fit into the canine fossa created by the Zygomatic process of the maxillary bone, the Alveolar process and the Canine eminence of the Maxillary bone. The insert (10) is held in place by the normal anatomy and surrounding structures of the area. Filling in this area by the insert (10), decreases the prominence of the nasolabial fold for the user. The connective piece (20) rests between the upper gum and upper lip to provide additional stability of the inserts (10).

The inserts (10) may be constructed of silicone rubber, silicone gel, soft polymers or soft plastics, including both organic and inorganic polymers. The insert (10) can be described as pill-shaped with a typical length of 10 to 25 millimeters (mm) and a typical diameter of 4 to 10 mm. The connective piece (20) may be constructed of the same materials as the inert (10). The connective piece (20) has a typical length of 40 to 50 mm and a typical width of 3 to 10 mm.

The Nasolabial Mouthpiece differs significantly from the Walton invention as the Walton invention is essentially a pad that fits between the cheek and gum to exert pressure on the cheek. The present invention is designed to fill a specific area of the oral anatomy, the canine fossa and thus reduce the inward direction of the nasolabial fold. The Nasolabial fold can be worn for extended periods of time without affecting the user's ability to eat, drink, talk or make any facial expressions.

Potential patent classifications for this invention include Class 433 Dentistry, Subclass 229 Miscellaneous and Class 623 Prosthesis, Subclass 66.1 Miscellaneous.

Figure 1:
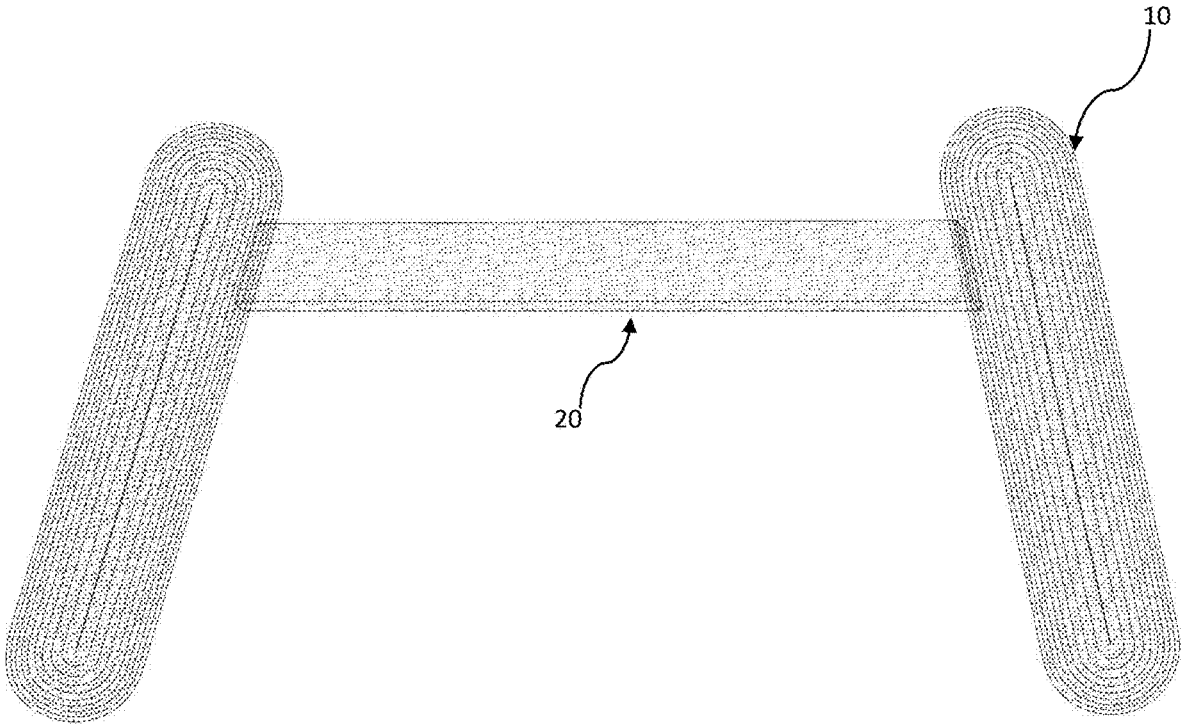
FIG. 1 is a view of the inserts (10) connected by the connective piece (20).
Figure 2:
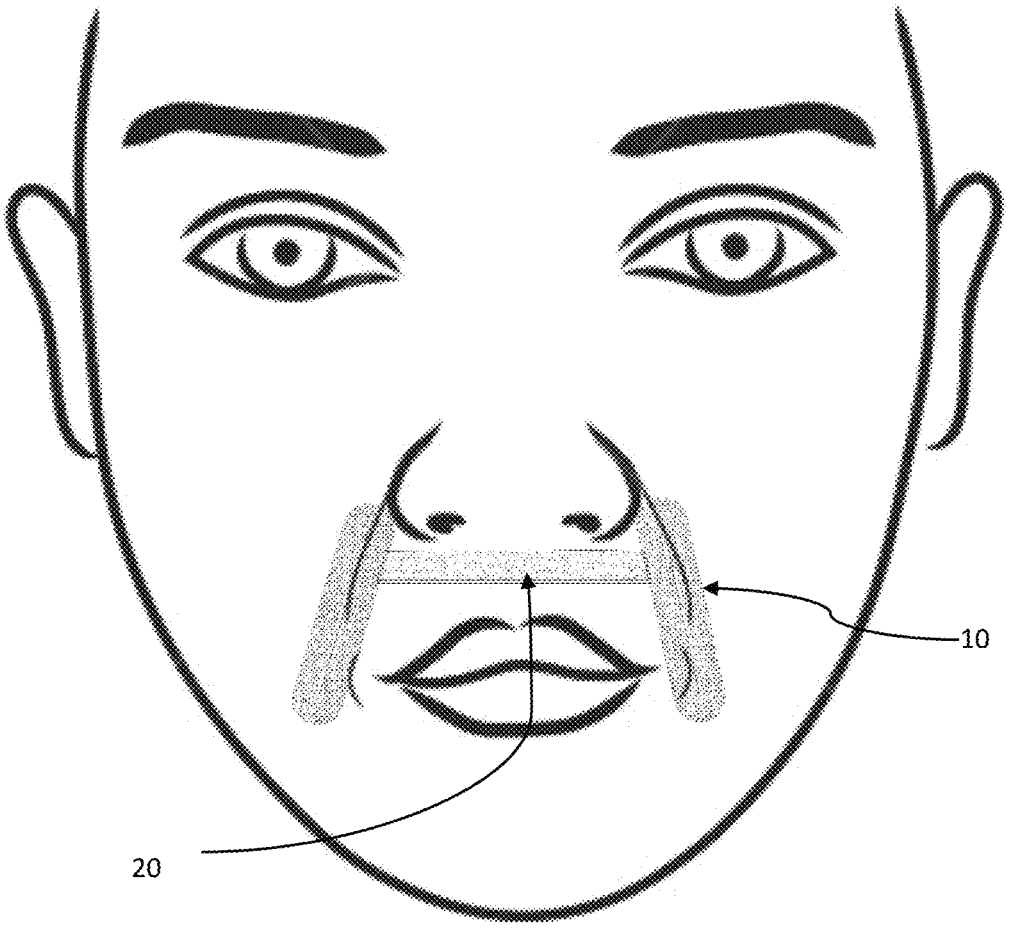
FIG. 2 is a view of the inserts (10) and connective piece (20) positioned inside the mouth.
Figure 3:
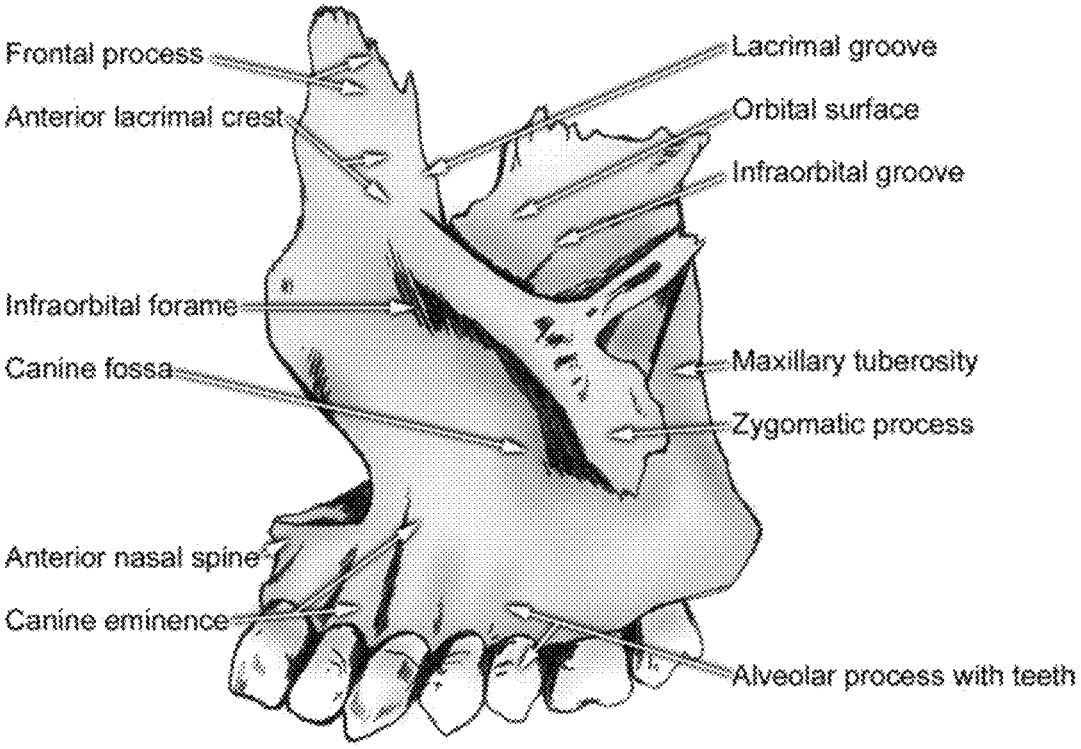
FIG. 3 is an anatomical drawing of the Maxillary bone.

The present invention described above and illustrated in FIGS. 1 through 2 is visualized as the preferred embodiment of the invention. It is envisioned that this invention may be embodied in many different forms and should not be construed as limited to the embodiments set forth herein. It will be understood by those skilled in the art that changes in forms and details may be made without departing from the spirit and scope of the present application. It is therefore intended that the present invention not be limited to the exact forms and details described and illustrated herein but falls within the scope of the appended claims.

The terminology used herein is for describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a stricture or feature that is disposed "adjacent" another feature may have portions that overlap or underlie the adjacent feature.

The invention claimed is:

1. A method for decreasing the inward direction of the nasolabial fold by using inserts to fill the canine fossa in the maxillary bone where said inserts are pill-shaped and 10 to 25 millimeters in length and 4 to 10 millimeters in diameter and where said inserts are attached to each other with a connective piece which is 40 to 50 millimeters in length and 3 to 10 millimeters in width and where said inserts and connective piece are constructed of silicone rubber, silicone gel, inorganic polymers or organic polymers.

* * * * *